US006951086B2

(12) United States Patent
Passeno

(10) Patent No.: US 6,951,086 B2
(45) Date of Patent: Oct. 4, 2005

(54) METHOD AND APPARATUS FOR MAKING THIN BRICK WALL FACING

(76) Inventor: James Kenneth Passeno, 116 W. State, Grant, MI (US) 49327

( * ) Notice: Subject to any disclaimer, the term of this patent is extended or adjusted under 35 U.S.C. 154(b) by 0 days.

(21) Appl. No.: 10/151,606

(22) Filed: May 20, 2002

(65) Prior Publication Data

US 2003/0213212 A1 Nov. 20, 2003

(51) Int. Cl.[7] ..... E04F 13/08

(52) U.S. Cl. ..... 52/386; 52/387; 52/385; 52/384; 52/302.3

(58) Field of Search ..... 52/386, 387, 385, 52/384, 302.3, 745.19; 156/299

(56) References Cited

U.S. PATENT DOCUMENTS

| | | | | |
|---|---|---|---|---|
| 658,868 A | | 10/1900 | Rosenbaum | |
| 4,011,702 A | | 3/1977 | Matyas | |
| 4,407,104 A | | 10/1983 | Francis | |
| 4,809,470 A | * | 3/1989 | Bauer et al. | 52/97 |
| 4,916,875 A | * | 4/1990 | Kashiwagi | 52/302.3 |
| 4,956,949 A | | 9/1990 | Francis | |
| 5,228,937 A | | 7/1993 | Passeno | |
| 5,311,714 A | * | 5/1994 | Passeno | 52/314 |
| 5,373,676 A | * | 12/1994 | Francis et al. | 52/387 |
| 5,526,630 A | | 6/1996 | Francis et al. | |
| 5,667,190 A | | 9/1997 | Scott et al. | |
| 5,715,637 A | | 2/1998 | Hesterman et al. | |
| 6,186,469 B1 | | 2/2001 | Scott | |

FOREIGN PATENT DOCUMENTS

| | | | |
|---|---|---|---|
| GB | 1478863 | * | 7/1977 |

* cited by examiner

*Primary Examiner*—Brian E. Glessner
*Assistant Examiner*—Chi Q. Nguyen
(74) *Attorney, Agent, or Firm*—VanOphem & VanOphem, P.C.

(57) ABSTRACT

A thin brick panel assembly having improved water drainage and integral brick retention. A substratum includes horizontal rows of dovetail-shaped projections with interruptions therein. Mortar ties having a flat plate portion, a substratum engagement extension, and mortar engagement extension are fastened to the substratum such that the mortar engagement extensions align with the interruptions in the projections. Bricks are snap-fit to the substratum over the mortar ties and between the projections. The bricks crush portions of the dovetail-shaped projections and lie flat against the mortar ties. Mortar is applied between the bricks and flows through apertures in the mortar engagement extensions of the mortar ties to interlock the mortar ties, the substratum and the bricks.

18 Claims, 4 Drawing Sheets

METHOD AND APPARATUS FOR MAKING THIN BRICK WALL FACING

CROSS-REFERENCES TO RELATED APPLICATIONS

Not applicable.

FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The present invention generally relates to brick panel wall construction. More specifically, this invention is directed to improvements in the components used in brick panel wall construction that result in improved water management, stronger mortar interlock, and better brick retention.

2. Description of the Related Art

For centuries brick walls have been used as a premium building material due to their strength, beauty, and durability. Unfortunately, brick walls are typically laid brick by brick, which tends to be time consuming, labor intensive, and thus expensive. Thin brick veneer was, therefore, developed as a means for achieving the beauty and durability of brick walls without the associated expense.

Thin brick panels can be premanufactured or can be assembled to a building on-site. Thin brick panels generally include a substratum, such as steel, aluminum, plywood, asphalt-impregnated fiberboard, cementitious board, polyurethane, or polystyrene foam board. With the on-site assembly method, the substratum is fastened to the exterior wall of a building in any conventional way and an array of thin bricks are applied to the substratum, typically with an adhesive. Then mortar, or grout is applied between the thin bricks.

The prior art has suggested a variety of thin brick panel constructions. One example is disclosed in U.S. Pat. No. 3,533,206 to Passeno, Jr., the inventor of the current application. The '206 patent teaches a building block holder for fabricating a veneer wall of thin bricks for attachment to a building. The building block holder includes a rigid panel having holes therethrough for convenient attachment to a wall. The rigid panel includes apertures therethrough such that when the thin bricks are glued to the rigid panel, adhesive flows into the apertures of the rigid panel for retaining the thin bricks on the panel. The rigid panel also includes spaced apart rows of vertically offset supporting tabs for supporting the thin bricks. Each thin brick is glued to the rigid panel and locates against a supporting tab such that a space is established between the top of each thin brick and the supporting tab directly above. Mortar is then applied between the bricks. A disadvantage with these teachings is that it is not optimized to drain moisture or water from behind the thin bricks. Moreover, although the adhesive interlocks to the rigid panel, the mortar is not interlocked to the rigid panel.

A second approach is taught by applicant's earlier U.S. Pat. No. 5,311,714, which teaches an improved brick panel construction apparatus for attaching to a wall. The apparatus includes a substratum of a stiff backing member made of polystyrene foam and that has one side to which is laminated a water impermeable sheet of vacuum-formed polystyrene. The water impermeable vacuum-formed sheet includes horizontal rows of integral projections that are spaced apart both vertically and horizontally. An array of brackets are fastened through the water impermeable sheet and stiff backing member to a wall. Each bracket has a flat portion and a top portion, wherein each top portion nests with part of a corresponding projection so as to partially overlap the projection and the flat portion overlies part of the vertical space between the horizontal rows of projections. Thin bricks are adhesively attached to the water impermeable sheet and rest on top of the brackets between the rows of projections. Grout or mortar is then applied to the spaces between the thin bricks so as to cover the projections. The brackets provide support for the bricks and also provide a mortar lock by allowing the mortar to extend around the flanges of the brackets and into the openings stamped in the brackets to inhibit the mortar from separating from the underlying sheet. Unfortunately, the manufacturing of the substratum is somewhat complex in that it involves vacuum forming a thin polystyrene sheet and laminating that sheet to the rigid polystyrene foam backing member.

Another example is disclosed in U.S. Pat. Nos. 5,373,676 and 5,501,049 to Francis et al., which teach thin brick panel assemblies for forming a brick facing on a building structure. Francis et al. teach the brick assembly including a backing member, support clips, thin bricks, glue, and mortar. The backing member includes horizontally extending parallel holding guides that extend outwardly from the backing member to define channels. The holding guides are spaced from one another and have flat top surfaces generally perpendicular to the backing member and one-half dovetail knife-edge bottom surfaces. Support clips are interspersed across the backing member and include a flat plate portion and a shelf portion for overlapping the flat top surface of a respective holding guide. The shelf portion of each support clip terminates outwardly in alternating rows of teeth. The thin bricks are glued and snapped into a respective channel such that a bottom surface of each thin brick rests either on the shelf portion of a respective support clip or on the flat top surface of a holding guide. A top surface of each thin brick slightly deforms the knife-edge of a respective retaining bar to hold the thin brick within its respective channel. Mortar is then applied between the bricks. Vertical V-shaped notches, or grooves, are vertically disposed between the rows of holding guides to provide water drainage and accept mortar therein.

A disadvantage with the Francis et al. patents, however, is that some of the thin bricks attach to the flat plate portion of a support clip and rest on the tops of the shelf portions of the support clips, while others do not. As the support clips are not embedded into the backing member, the thin bricks attached to the flat plate portion of a support clip extend away from the wall further than the thin bricks attached directly to the backing member. Thus, a brick wall assembled in this manner will have an irregular pattern of protruding bricks affecting the aesthetic appearance of the wall. Furthermore, the bricks resting on the flat plate portion of a support clip are vertically higher than the bricks attached directly to the backing member giving rise to uneven rows of thin bricks.

Another disadvantage with the Francis et al. patents is that the thin vertical notches only permit a relatively small amount of water to escape from under the mortar, and only in vertically spaced apart portions of the panel assembly.

Additionally, and as shown in the cross-section of FIG. 3 of the Francis et al. patents, the interlocking rows of teeth of the support clips lie just below the surface of the mortar, which is insufficiently shallow to optimally finish the retaining grout, and results in the teeth showing after a finish trowel is passed down the mortar or grout groove.

Finally, the Francis et al. patents disclose holding guides having a flat top surface and one-half dovetail knife-edge bottom surfaces so that only the top edge of each thin brick is pressed to deform the knife-edge of the respective holding guide. Thus, the thin bricks are not optimally retained to the backing member and may fall off the wall after assembly.

From the above, it can be appreciated that thin brick panel assemblies of the prior art are not cost effectively optimized to manage drainage of water from under the mortar and to provide a robust integral engagement of the thin bricks to the substratum. Therefore, what is needed is a thin brick panel assembly that incorporates novel water management and retaining features in a substratum and improved support clip design to improve the water management, mortar interlock, and brick retention of the assembly.

BRIEF SUMMARY OF THE INVENTION

According to the preferred embodiment of the present invention, there is provided a thin brick panel assembly adapted for mounting to a building structure. The thin brick panel assembly includes thin bricks, a substratum, mortar ties, and mortar.

The thin bricks each have a front surface, a back surface, a top surface, a bottom surface, and opposed side surfaces. Each brick has a width defined between the opposed side surfaces, a height defined between the top and bottom surfaces, and a depth defined between the front and back surfaces. The back surface of the thin bricks includes vertical weeping grooves that improve water migration by channeling water that would otherwise become trapped between the bricks and the substratum.

The substratum includes an array of horizontally disposed retaining channels for accepting the thin bricks therein. The retaining channels are defined by an array of integral retaining projections. The retaining projections have a dovetail shaped transverse cross section defining a top and bottom knife-edge surface. The retaining projections are disposed in a generally parallel pattern of rows and are spaced apart a distance that is less than the height of each of the thin bricks such that the retaining projections interferingly engage the top and bottom surfaces of the thin bricks to retain the thin bricks within the retaining channels.

The retaining projections include an array of segmented interruptions or interruptions arranged in a diagonal pattern such that each interruption slightly overlaps the interruptions directly above and below. Within each retaining projection, the interruptions are horizontally spaced to coincide with the standard distance between wall studs (typically 16 or 24 inches). Furthermore, the overlapping diagonal pattern repeats itself such that each individual interruption aligns vertically with another interruption approximately every 16 inches.

The interruptions work in conjunction with the weeping grooves to channel out water from behind the bricks. The excessive horizontal distance between the drainage grooves of the prior art restricts moisture migration, and typically only the water in the vicinity of the groove is channeled out. The spacing and arrangement of the interruptions in the preferred embodiment greatly reduces the horizontal distance between interruptions such that the channeling system is accessible to any water behind the thin bricks.

The mortar ties are disposed between the thin bricks and the substratum such that the mortar ties are respectively aligned with the interruptions. Each mortar tie includes a flat plate portion with fastening holes, a substratum engagement extension terminating one end of the flat plate, and a mortar engagement extension terminating another end of the flat plate portion. Each mortar engagement extension includes apertures therethrough and is disposed within one of the interruptions. The substratum engagement extension extends into the substratum such that the flat plate portion lies flat against the substratum in a respective retaining channel.

As previously indicated, the spacing of the interruptions corresponds both horizontally and vertically with standard distances between wall studs. In a typical example, a plurality of interruptions vertically spaced 16 inches apart are vertically aligned with each wall stud. A mortar tie is disposed in only those interruptions that align with a stud. After initially attaching the substratum to the building with an adhesive, a fastener is inserted through one of the fastening holes of each mortar tie, through the substratum and into the wall stud. The fastener is preferably run down tightly to embed the mortar tie into the substratum such that the mortar tie will lie flush with the front surface of the substratum.

After the substratum and mortar ties are attached to the building, adhesive is applied to the retaining channels of the substratum. The thin bricks are inserted into the retaining channels such that the top and bottom surfaces of each thin brick engage the knife-edge surfaces of the retaining projections. Upon pressing the brick toward the substratum, the respective knife-edge surfaces buckle and compact into the dovetailed area establishing a frictional interference fit sufficient to hold the bricks in place until the adhesive cures.

The thin bricks are arranged horizontally according to conventional thin brick spacing and arranged vertically as dictated by the retaining projections. Mortar is applied between the thin bricks such that the mortar covers and flows into the mortar engagement extensions and through the apertures. In this manner, the mortar interlocks the bricks, mortar ties and substratum so that the thin brick panel assembly is optimally retained to the building.

It is an object of the present invention to provide an improved brick panel assembly and related method.

It is another object to provide a brick panel assembly and related method that, compared to the prior art, provides better water management by more completely permitting moisture to drain therefrom.

It is still another object to provide a brick panel assembly and related method that is more economical and more reliable than the prior art.

It is yet another object to provide a brick panel assembly and related method where bricks lie flat against the substratum and frictionally engage projections of the substratum for better integral interlock compared to the prior art.

It is a further object to provide a brick panel assembly and related method that provides improved mortar interlock and brick retention compared to the prior art.

These objects and other features, aspects, and advantages of this invention will be more apparent after a reading of the following detailed description, appended claims, and accompanying drawings.

DETAILED DESCRIPTION OF THE PREFERRED EMBODIMENT

Generally shown in the Figures, a thin brick panel assembly is provided in accordance with the present invention. The term substratum as used herein is synonymous with backing member and means any member or element that constitutes a base for supporting another member or element.

Figure 1:
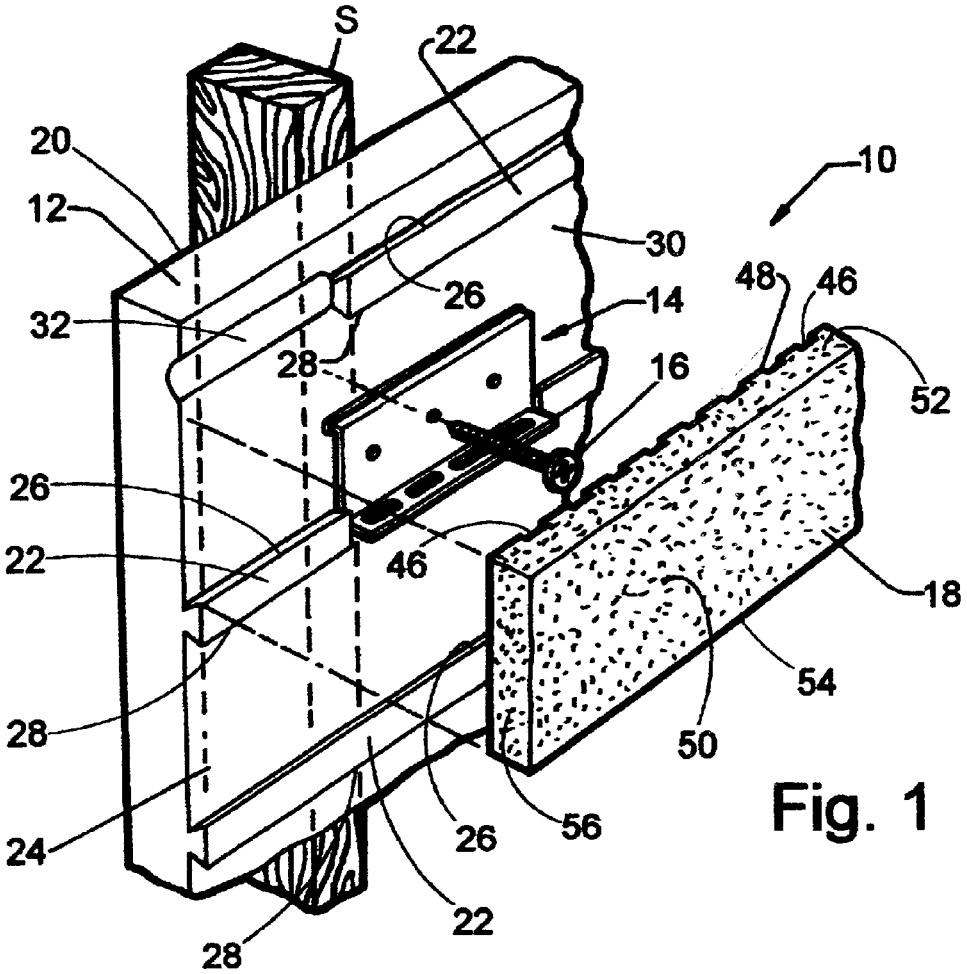
FIG. 1 is a partial exploded perspective view of a brick panel assembly according to the present invention being applied to a building structure.

Referring now to the Figures, there is shown in FIG. 1 a portion of a thin brick panel assembly 10 that is constructed in accordance with the present invention. The thin brick panel assembly 10 includes a substratum 12, mortar ties 14, fasteners 16, bricks 18 and mortar 58 (see FIG. 6). The thin brick panel assembly 10 is shown attached to a wall stud S of a building structure. The substratum 12 is prefastened between adjacent wall studs S by applying a bead of construction adhesive (not shown) down the wall studs S, pressing a back surface 20 of the substratum 12 to the wall studs S, and then leveling the substratum 12 thereto before the construction adhesive sets. The substratum 12 is further attached to the wall studs S using the fasteners 16 and mortar ties 14 as shown and as will be discussed in greater detail below.

The substratum 12 is preferably composed of polystyrene foam that is formed from a single sheet. A plurality of integral retaining projections 22 extend horizontally across a front surface 24 of the substratum 12. The retaining projections 22 are parallel and vertically spaced apart such that the distance therebetween is slightly less than the height of the bricks 18 so as to achieve an interference fit therebetween as will be discussed hereinafter. The retaining projections 22 are dovetail-shaped in transverse cross-section and thereby define knife-edge top and bottom edges 26 and 28. Vertically adjacent rows of retaining projections 22 define retaining channels 30 into which the bricks 18 are eventually inserted. The retaining projections 22 establish proper vertical spacing of the bricks 18 and by frictional interference as will be described below retain the bricks 18 within the retaining channels 30. The retaining projections 22 are preferably formed by wire cutting the foam substratum 12 or, alternately, the substratum 12 could be extruded to yield the retaining projections 22.

Figure 8:
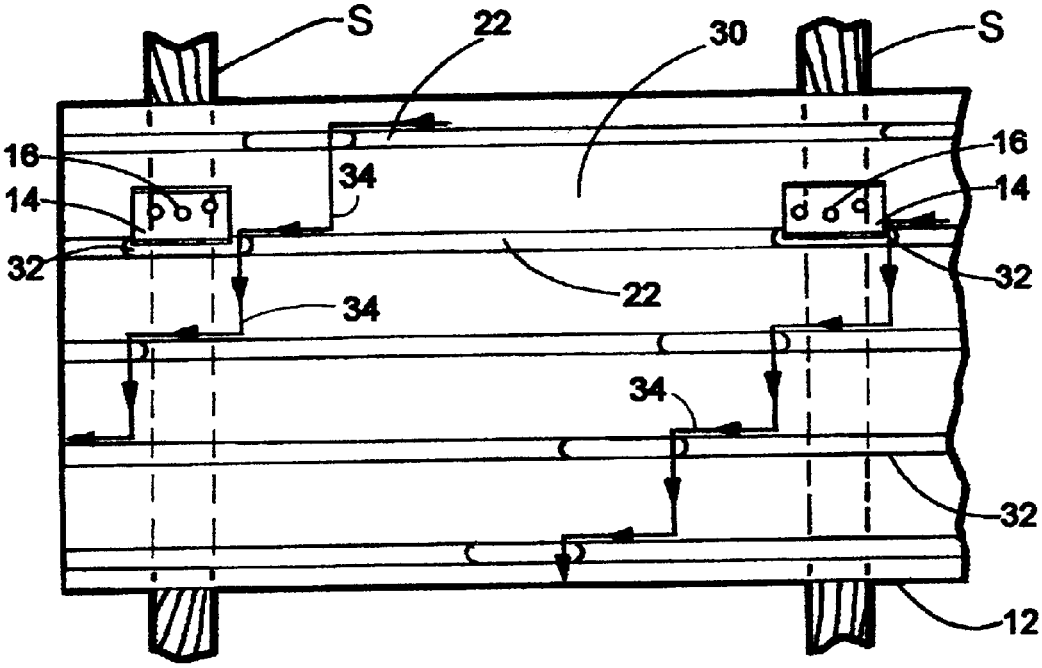
FIG. 8 is a partial front view of a brick panel assembly as applied to a building structure and showing water drainage across the front of the substratum.

The retaining projections 22 are interrupted by cavities or interruptions 32 that are either cut, burned, or otherwise formed into the substratum 12. The interruptions 32 are arranged in a diagonal array as best shown in FIG. 8, and overlap slightly from one row down to the next for optimal downward migration of water. The interruptions 32 are horizontally staggered as a function of the distance between consecutive wall studs S (typically 16 or 24 inches). Furthermore, the overlapping diagonal pattern is such that each individual interruption 32 aligns vertically with another interruption 32 approximately every 16 inches. The interruptions 32 are used primarily for water drainage, but also provide clearance for anchoring the mortar ties 14 as will be discussed in more detail below.

Each brick 18 has a back surface 48, a front surface 50, a top edge 52, a bottom edge 54, and opposed side edges 56. The width of each brick 18 is defined between the opposed side edges 56, the height is defined between the top and bottom edges 52 and 54, and the thickness or depth is defined between the back and front surfaces 48 and 50. The bricks 18 are composed of any acceptable thin brick material, and preferably include vertically disposed weeping grooves 46 in the back surfaces 48 thereof. The weeping grooves 46 in the bricks 18 work in conjunction with the interruptions 32 to allow water to escape from between the bricks 18 and the substratum 12.

Figure 2:
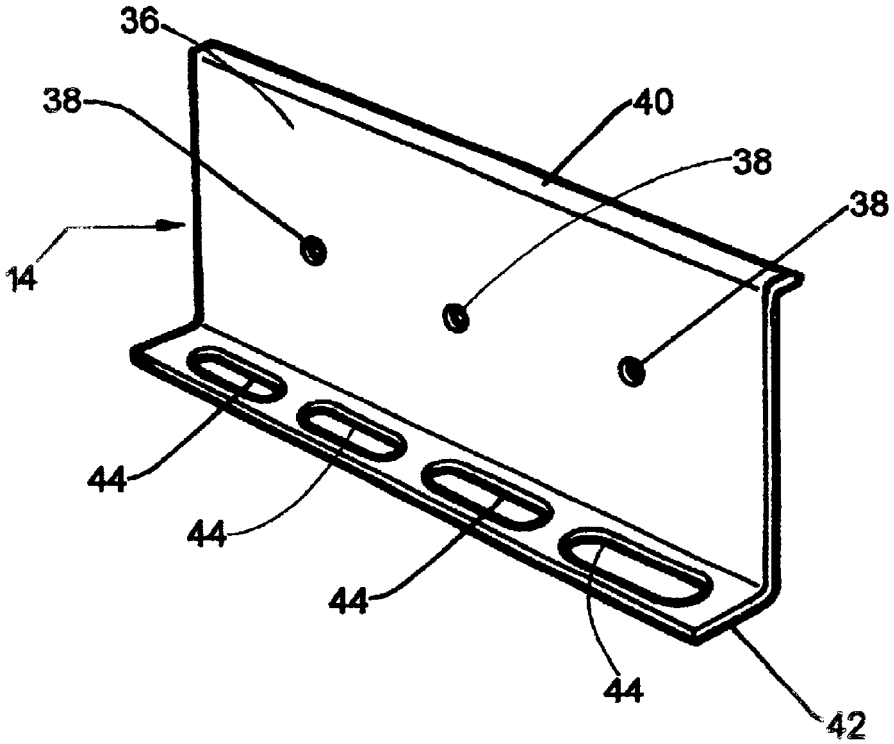
FIG. 2 is an isometric view of a mortar tie for use with the brick panel assembly of the present invention.

Referring to FIG. 2, an isometric view depicting the mortar tie 14 is provided. Each mortar tie 14 includes a flat plate portion 36 with fastening holes 38 therethrough, a substratum 12 engagement extension 40, and a mortar engagement extension 42 with mortar apertures 44 therethrough. The mortar ties 14 are positioned such that the flat plate portion 36 lies flat against the front surface 24 of the substratum 12 within one of the retaining channels 30, and the substratum engagement extension 40 is pressed into the front surface 24 of the substratum 12. The width of each mortar tie 14 is slightly less than the width of the interruptions 32 such that the mortar engagement extension 42 centers, both horizontally and vertically, within the corresponding interruption 32 as shown in FIG. 1.

Referring again to FIG. 1, the fastener 16 is driven through one of the fastening holes 38 of the mortar tie 14, through the substratum 12 and into one of the wall studs S. The fasteners 16 are typically nails or screws, and secure the substratum 12 to the wall stud S. Additionally, the fastener 16 is preferably run down tightly to embed the mortar tie 14 into the substratum 12 such that the mortar tie 14 will lie flush with the front surface 24 of the substratum 12. In turn, the bricks 18 inserted on top of a mortar tie 14 will lie flat against the front surface 24 of the substratum 12 within the retaining channel 30. Thus, the stack up or lie of each brick 18 should not be affected by the mortar engagement extension 42 or the flat plate portion 36 of the mortar tie 14.

Figure 3:
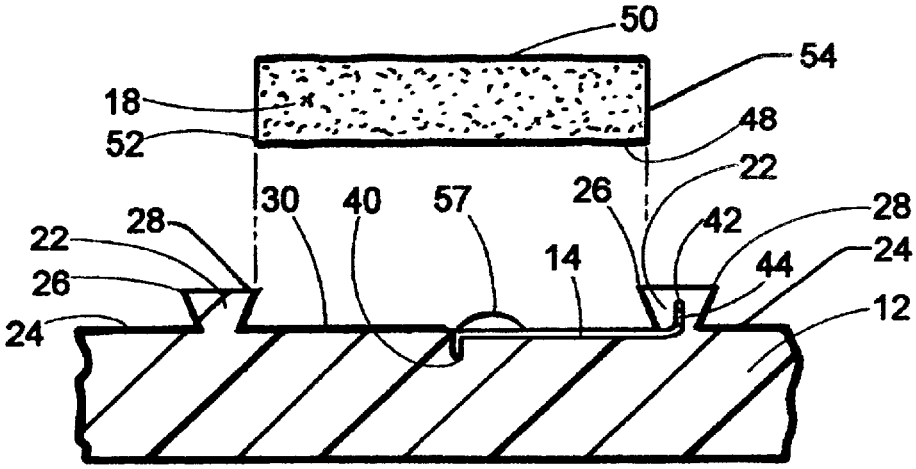
FIG. 3 is a partial cross-sectional view of a brick being assembled to the substratum between adjacent projections of the substratum.

Referring to FIG. 3, a thin bead of slow setting construction adhesive 57 is preferably applied to the front surface 24 of the substratum 12 in the retaining channels 30. It should be apparent to one of ordinary skill in the art that excessive application of the slow setting construction adhesive 57 will inhibit weeping between the weeping grooves 46 of the bricks 18 and the substratum 12. The bricks 18 are installed individually to the substratum 12 according to standard horizontal thin brick spacing and to vertical spacing as dictated by the retaining projections 22.

Figure 4:
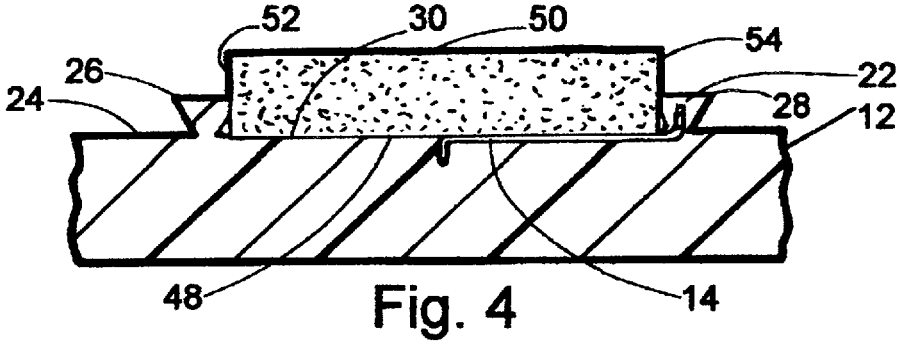
FIG. 4 is a partial cross-sectional view of the brick as assembled to the substratum.

As shown in FIGS. 3 and 4, each brick 18 is centered between vertically adjacent retaining projections 22 and firmly pressed toward the front surface 24 of the substratum 12 into the respective retaining channel 30. The top and bottom edges 52 and 54 of the brick 18 initially engage respective bottom and top knife-edges 28 and 26 of vertically adjacent retaining projections 22. Upon pressing the brick 18 toward the substratum 12, the bottom and top knife-edges 28 and 26 buckle and compact into a base portion of the dovetail shaped retaining projections 22 in response to the insertion of the top and bottom edges 52 and 54 of the brick 18. Thus, the brick 18 moves into frictional interference between vertically adjacent retaining projections 22 to sufficiently hold the brick 18 in place until the adhesive 57 cures. As can be seen in FIG. 4, even with one of the mortar ties 14 disposed behind the brick 18, the brick 18 lies flat against the substratum 12 and centered between the retaining projections 22. In other words, the thickness of the mortar tie 14 should not affect the surface to surface contact of the brick 18 against the substratum 12.

Figure 5:
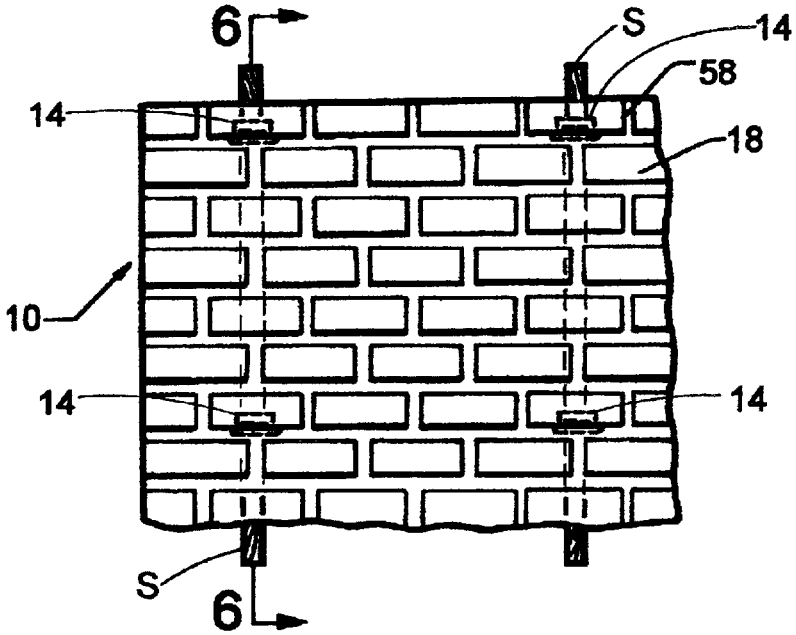
FIG. 5 is a partial front view of a brick panel assembly applied to a building structure.

FIG. 5 is a partial front view of the thin brick panel assembly 10 and illustrates the arrangement of mortar ties 14 and thin bricks 18 on the substratum 12. A single mortar tie 14 is allocated to only those interruptions that align with one of the wall studs S. The spacing of the interruptions 32 corresponds both horizontally and vertically with the standard distance between the wall studs S in a building structure. For example, in a building structure in which the wall studs S are separated by 16 inches, an appropriate substratum 12 will include interruptions 32 that align vertically and horizontally every 16 inches, and a plurality of interruptions 32 vertically spaced 16 inches apart will align with each wall stud S. The bricks 18 are arranged horizontally with each other and vertically relative to the retaining projections 22. The arrangement of the bricks 18 relative to the mortar ties 14 is not critical.

Figure 6:
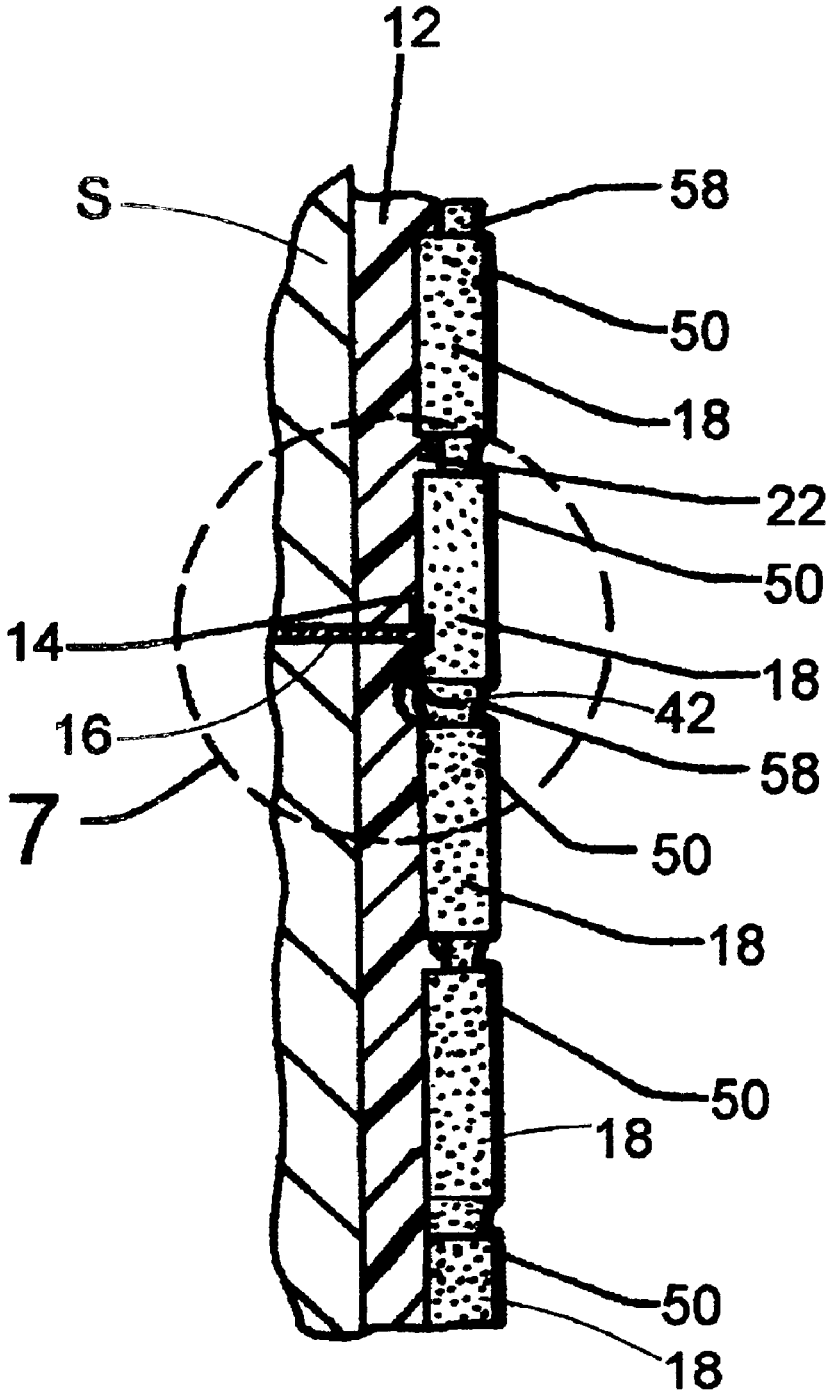
FIG. 6 is a partial cross-sectional view of the brick panel assembly of FIG. 2 taken along lines 3—3 thereof.

Referring now to FIG. 6, the mortar 58 is applied between the bricks 18 in accordance with any method well known in the art, and is preferably applied with a single point applicator nozzle and mortar pump system. The mortar 58 fills the area between the bricks 18 thereby covering the retaining projections 22 such that the retaining projections 22 are not visible. Uniquely, mortar 58 flows through the mortar apertures 44, and over the mortar engagement extensions 42 to interlock the mortar 58 with the mortar tie 14. This configuration results in a more positive interlock of the mortar 58 with the mortar ties 14, compared to the prior art. Thus a strong, positive interlock is created between the mortar 58, the mortar tie 14, the fastener 16, the bricks 18 and the underlying wall.

Figure 7:
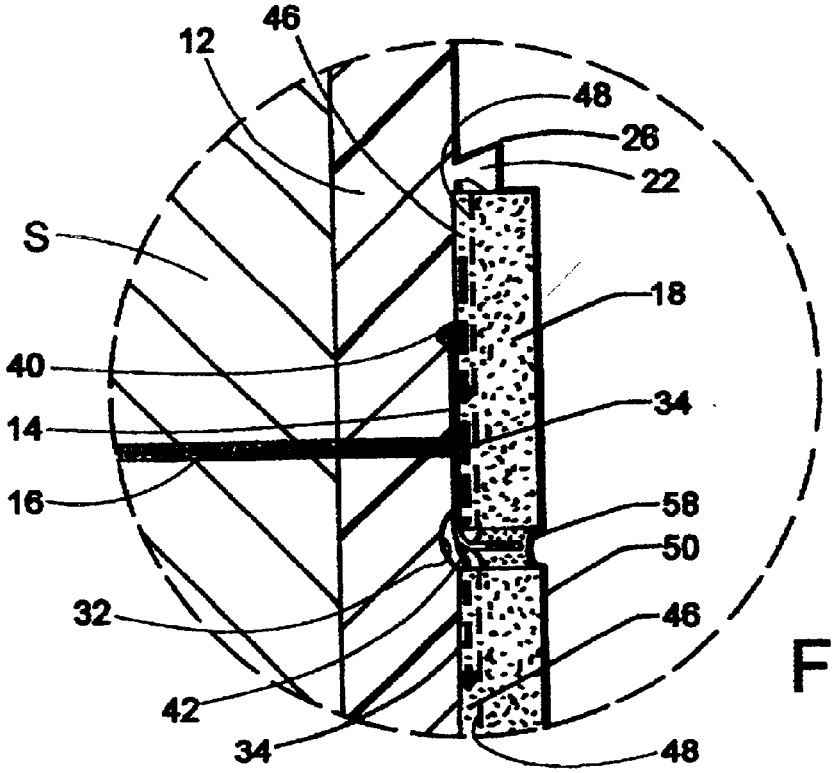
FIG. 7 is an enlarged cross-sectional view of circle 7 of FIG. 6 showing water drainage between bricks and a substratum.

FIGS. 7 and 8 illustrate how the present invention provides improved migration of water behind the bricks 18 and the mortar 58. Arrows 34 represent water weeping between the substratum 12 and the and the bricks 18. The water passes between the vertical weeping grooves 46 (shown in FIG. 1) in the back surface 48 of the bricks 18, to a base portion of the dovetailed retaining projections 22, along the retaining projection 22 to the interruption 32 where it can pass down through the weeping grooves 46 of a lower row of bricks 18.

FIG. 8 shows the migration of water arrows 34 in frontal view. The water channels down through the weeping grooves 46 (shown in FIG. 1), horizontally along the top knife-edge 26 of the retaining projections 22 and down through the interruptions 32. The water is most likely to become trapped in regions in which it must channel horizontally and minimization of these regions greatly improves water migration. The excessive horizontal distance between the drainage grooves of the prior art restricts moisture migration, and typically only the water in the vicinity of the drainage groove is channeled out. In FIG. 8, it can be seen that the spacing and arrangement of the overlapping interruptions 32 minimize the horizontal distance between the interruptions 32 such that the channeling system is accessible to any water behind the bricks 18.

As can seen from the above description of the preferred embodiment, the present invention provides improved water management through an overlapping diagonal pattern of interruptions 32 in the retaining projections 22 of the substratum 12 in conjunction with weeping grooves 46 in the bricks 18. The mortar apertures 44 in the mortar ties 14 also enable better interlocking of the mortar 58, the bricks 18 and the substratum 12 to the wall studs S. The unique orientation of the mortar ties 14 that are horizontally and vertically centered with respect to the interruptions 32 enable the bricks 18 to lie flat against the substratum 12.

While the present invention has been described in terms of the preferred embodiment, it is apparent that other forms could be adopted by one skilled in the art. In other words, the teachings of the present invention encompass any reasonable substitutions or equivalents of claim limitations. For example, the structure, materials, sizes, and shapes of the individual components could be modified, or substituted with other similar structure, materials, sizes, and shapes. Specific examples include substituting the foam substratum 12 for an interior wallboard material such as drywall or gypsum board. Accordingly, the scope of the present invention is to be limited only by the following claims.

What is claimed is:

1. A brick panel assembly comprising:

a plurality of bricks;

a substratum having a front surface for supporting said plurality of bricks thereon, said substratum comprising a plurality of retaining projections spaced apart in a plurality of rows, each of said plurality of retaining projections extending in a direction away from said front surface defining a plurality of channels therebetween for accepting said plurality of bricks therein, each of said plurality of retaining projections having:

a dovetail-shaped transverse cross section prior to acceptance of said plurality of bricks therebetween; and at least one interruption defining a cavity in said front surface of said substratum;

said interruptions in each of said plurality of retaining projections arranged in a diagonal array from one row down to the next row of said plurality of rows for optimal migration of water;

at least one mortar tie mounted to said front surface of said substratum, said at least one mortar tie having:

one end portion extending in a direction towards said substratum such that upon mounting said at least one mortar tie to said front surface said one end portion embeds into said front surface of said substratum; and an opposite end portion extending in a direction away from said front surface, said opposite end portion of said at least one mortar tie disposed substantially aligned with respect to said interruption defining said cavity in said front surface of said substratum between said plurality of bricks, said opposite end portion of said at least one mortar tie having at least one aperture; and mortar disposed between said plurality of bricks and through said at least one aperture of said opposite end portion of said at least one mortar tie whereby upon curing said mortar interlocks with said at least one aperture in said opposite end portion of said at least one mortar tie to permanently hold said plurality of bricks and said substratum together further whereby said diagonal array of interruptions provide a continuous migration path for water from said brick panel assembly.

2. The brick panel assembly as claimed in claim 1, wherein each of said plurality of bricks has a predetermined height, and further wherein said plurality of retaining projections are generally parallel and spaced apart a distance less than said predetermined height of each of said plurality of bricks, such that said plurality of retaining projections interferingly engage said plurality of bricks in longitudinal engagement to retain said plurality of bricks within said plurality of retaining channels.

3. The brick panel assembly as claimed in claim 1, wherein said plurality of retaining projections include a plurality of interruptions defining a plurality of cavities disposed in a diagonal pattern across said substratum for allowing water to drain down between said plurality of retaining projections when said substratum is in a generally vertical orientation such that said plurality of retaining projections are in a generally horizontal orientation.

4. The brick panel assembly as claimed in claim 3, further comprising a plurality of mortar ties, wherein each of said plurality of mortar ties is respectively centrally aligned with a respective one of said plurality of cavities defined by said plurality of interruptions, each mortar tie of said plurality of mortar ties further comprising:

a flat plate portion interposes between said one end portion and said opposite end portion, said flat plate portion adapted to accept a fastener therethrough; and wherein said opposite end portion of said at least one mortar tie comprises a mortar engagement extension having said aperture therein, said mortar engagement extension extending from said flat plate portion in a direction opposite that of said one end portion, said mortar engagement extension overlaying a respective cavity of said plurality of cavities defined by said plurality of interruptions.

5. The brick panel assembly as claimed in claim 1, wherein said plurality of bricks each comprise a back surface having a plurality of grooves for enabling water drainage, and further comprising an adhesive disposed on said back surface of said plurality of bricks to adhesively attach said brick to said substratum.

6. The brick panel assembly as claimed in claim 1, wherein said substratum further comprises polystyrene foam such that when a brick is inserted in said channel and the width of the brick is wider than the width of said channel a portion of said dovetail-shaped cross-section of said plurality of retaining projections of said substratum yield and partially crush said polystyrene foam during the insertion of said brick to thereby frictionally retain said brick in said channel.

7. A brick panel assembly adapted for paneling a building structure, said brick panel assembly comprising:

a plurality of thin bricks, wherein each of said plurality of thin bricks has a predetermined height;

a substratum having a front surface for supporting said plurality of thin bricks thereon, said substratum comprising at least one retaining channel for accepting said plurality of thin bricks therein, said at least one retaining channel being defined by a pair of retaining projections, each of said pair of retaining projections having a dovetail-shaped transverse cross-section prior to insertion of said plurality of thin bricks therebetween, said pair of retaining projections being generally in horizontal rows and spaced apart a distance less than said predetermined height of said plurality of thin bricks such that said pair of retaining projections interferingly engage said plurality of thin bricks to retain said plurality of thin bricks within said retaining channel, each of said pair of retaining projections having an interruption defining a cavity in said front surface of said substratum, said interruptions in said pair of retaining projections arranged in a diagonal array from one row down to the next row for optimal migration of water;

at least one mortar tie mounted to said front surface of said substratum, said at least one mortar tie having one end portion extending in a direction towards said front surface such that upon mounting said at least one mortar tie to said front surface said one end portion embeds into said front surface; and an opposite end portion extending in a direction away from said front surface, said opposite end portion of said at least one mortar tie disposed substantially aligned with said cavity in said front face of said substratum between said plurality of thin bricks, said at least one mortar tie comprising:

a flat plate portion;

said one end portion inserted into said substratum such that said flat plate portion lies flat aligned with said front surface of said substratum in said retaining channel; and said opposite end portion of said at least one mortar tie comprises a mortar engagement extension disposed within said interruption; said mortar engagement extension comprising at least one aperture; and mortar disposed between said plurality of thin bricks and through said at least one aperture of said opposite end of said at least one mortar tie whereby upon curing said mortar interlocks with said at least one aperture in said opposite end of said at least one mortar tie to permanently hold said plurality of thin bricks and said substratum together and further whereby said diagonal array of cavities provide continuous migration path for water from said brick panel assembly.

8. The brick panel assembly as claimed in claim 7, further comprising an adhesive disposed between said plurality of thin bricks and said front surface of said substratum.

9. The brick panel assembly as claimed in claim 7, further comprising a fastener extending through said flat plate portion of said at least one mortar tie, through said substratum, and into said building structure for fastening said at least one mortar tie and said substratum to said building structure.

10. The brick panel assembly as claimed in claim 7, wherein said substratum is composed of polystyrene foam.

11. The brick panel assembly as claimed in claim 7, wherein each of said plurality of thin bricks comprise a back surface having grooves for enabling water drainage.

12. A brick panel assembly adapted for mounting to a building structure, said brick panel assembly comprising:

a plurality of thin bricks, said plurality of thin bricks each having a front surface, a back surface opposite said front surface, a top surface, a bottom surface opposite said top surface, and two opposed side surfaces, said plurality of thin bricks each having a width defined between said two opposed side surfaces, a height defined between said top and said bottom surfaces, and a depth defined between said front and said back surfaces;

a substratum having a front surface for supporting said plurality of thin bricks thereon, said substratum comprising a plurality of retaining channels for accepting said plurality of thin bricks therein, said plurality of retaining channels defined by a plurality of retaining projections extending in a direction away from said front surface, said plurality of retaining projections having a dovetail-shaped transverse cross-section prior to acceptance of said plurality of thin bricks therebetween, said plurality of retaining projections being disposed in a generally horizontal pattern of rows, said plurality of retaining projections being spaced apart a distance that is less than said height of each of said plurality of thin bricks such that said plurality of retaining projections interferingly engage one of said top and said bottom surfaces of said plurality of thin bricks along the lengths thereof to retain said plurality of thin bricks in said plurality of retaining channels, said plurality of retaining projections having a plurality of interruptions defining a plurality of cavities in said front surface of said substratum, said plurality of cavities being arranged in a diagonal pattern from one row down to the next row of said horizontal pattern of rows for optimal migration of water across said substratum;

a plurality of mortar ties disposed between said plurality of thin bricks and said substratum, each one of said plurality of mortar ties being aligned respectively with each one of said plurality of cavities, each one of said plurality of mortar ties comprising:

a flat plate portion;

a substratum engagement extension terminating one end of said flat plate portion; and a mortar engagement extension terminating an opposite end of said flat plate portion, said mortar engagement extension having at least one aperture therethrough, said mortar engagement extension being aligned within said plurality of interruptions of said plurality of retaining projections whereby said flat plate portion of each one of said plurality of mortar ties is mounted to said substratum in one of said plurality of retaining channels flush with said front surface of said substratum such that said substratum engagement extension imbeds into said substratum and said opposite end extension overlies a respective cavity of said plurality of cavities; and mortar disposed between said plurality of thin bricks and through said at least one aperture of said mortar engagement extension of each one of said plurality of mortar ties to permanently interlock said plurality of thin bricks and said substratum together such that said diagonal pattern of cavities provides a continuous migration path for water to drain from said brick panel assembly.

13. The brick panel assembly as claimed in claim 12, wherein said plurality of interruptions are arranged in a vertically-overlapping diagonal pattern to enhance the drainage of water.

14. The brick panel assembly as claimed in claim 12, wherein said back surface of said plurality of thin bricks comprises at least one groove therein to enhance the drainage of water.

15. The brick panel assembly as claimed in claim 12, wherein said substratum is composed of polystyrene foam.

16. The brick panel assembly as claimed in claim 15, wherein at least a portion of each of said plurality of retaining projections yields and crushes upon acceptance of said plurality of thin bricks whereby said interfering engagements is created.

17. The brick panel assembly as claimed in claim 12, further comprising adhesive disposed on said front surface between said plurality of thin bricks and said substratum.

18. The brick panel assembly as claimed in claim 12, further comprising a fastener extending through each of said flat plate portions of said plurality of mortar ties to fasten said plurality of mortar ties and said substratum to said building structure.

* * * * *